US008456325B1

(12) United States Patent
Sikora

(10) Patent No.: US 8,456,325 B1
(45) Date of Patent: Jun. 4, 2013

(54) NETWORKED STREETLIGHT SYSTEMS AND RELATED METHODS

(75) Inventor: Scott Sikora, Gilbert, AZ (US)

(73) Assignee: Tomar Electronics, Inc., Gilbert, AZ (US)

( * ) Notice: Subject to any disclaimer, the term of this patent is extended or adjusted under 35 U.S.C. 154(b) by 249 days.

(21) Appl. No.: 12/824,048

(22) Filed: Jun. 25, 2010

Related U.S. Application Data

(60) Provisional application No. 61/221,441, filed on Jun. 29, 2009.

(51) Int. Cl.
*G08G 1/07* (2006.01)

(52) U.S. Cl.
USPC ..... 340/909; 340/917; 340/994

(58) Field of Classification Search
USPC ..... 340/909, 917, 994
See application file for complete search history.

(56) References Cited

U.S. PATENT DOCUMENTS

| | | | | |
|---|---|---|---|---|
| 2002/0102961 | A1* | 8/2002 | Gibbons et al. | 455/404 |
| 2007/0085701 | A1* | 4/2007 | Walters et al. | 340/870.02 |
| 2007/0096892 | A1* | 5/2007 | Nathan et al. | 340/471 |
| 2007/0222581 | A1* | 9/2007 | Hawkins et al. | 340/539.1 |
| 2011/0001626 | A1* | 1/2011 | Yip et al. | 340/635 |

* cited by examiner

*Primary Examiner* — Tai T Nguyen
*Assistant Examiner* — Ojiako Nwugo
(74) *Attorney, Agent, or Firm* — Booth Udall Fuller, PLC

(57) ABSTRACT

A networked streetlight system associated with a central control system having control over illumination settings for a plurality of luminaires within the networked system. Particular embodiments may be used specifically with emergency vehicles to guide the vehicles to emergency destinations through the combination of knowing the location of the vehicle and its destination, and having control over the networked luminaires, each having specific illumination settings controls. Examples of illumination settings include strobe, color and intensity.

26 Claims, 6 Drawing Sheets

NETWORKED STREETLIGHT SYSTEMS AND RELATED METHODS

CROSS REFERENCE TO RELATED APPLICATIONS

This Application claims the benefit of the filing date of U.S. Provisional Patent Application 61/221,441 to Scott T. Sikora entitled Networked Light Emitting Diode Streetlight Systems and Related Methods which was filed on Jun. 29, 2009, the disclosure of which is incorporated herein by reference.

BACKGROUND

1. Technical Field

Implementations of streetlight systems relate to systems and methods for providing outdoor illumination typically to illuminate a street or road.

2. Background Art

Various types of streetlights are known in the art. Traditional street lights or street lamps are found along sides of roads for the sole purpose of illuminating the road below them. A standard streetlight structure is a light post that extends from the ground with an extended arm that overhangs a street with an overhead light that may include reflectors to direct the light toward the street. Streetlights are distinct from traffic lights, which serve an entirely different function than a streetlight and include light directed in a single horizontal direction rather than downward to light a street or horizontally in all directions.

Some streetlights turn on and off based on the input from a light sensor and others are configured to follow a preset timer for turning on and off.

SUMMARY

Implementations of a networked streetlight system are disclosed that may include a communication or a signal between a central control system, a communications module and a luminaire that changes the setting of the light of the luminaire to pulse illumination, change to one or a combination of multiple colors or increase or decrease light intensity (power consumption). The luminaire in disclosed implementations are specific to streetlights and is part of a streetlight housing. Particular implementations of the networked streetlight system include multiple luminaires and multiple communications modules that receive a signal from a central control system. The communication modules may correspond one to one with each luminaire in a system or there may be one communication module that communicates with a group of luminaires. Entire network systems may include multiple communication modules signaling multiple luminaires across different areas.

Implementations of networked streetlight systems like those disclosed in this document may have the following advantages over the current state-of-the-art:

The luminaire may include a light emitting diode (LED) or an incandescent light and may include the communications module within the luminaire housing. The communications module may also be mounted on the streetlight body itself or in a remote location away from the luminaire and streetlight or on a traffic signal support. Other implementations may allow the luminaire to send a signal to the central control system such as sending a status update of the condition of the luminaire back to the central control system through the communications module. The communication connection between the central control system, the communications module and the luminaire may be wired or wireless or a combination of both.

The networked streetlight system also allows a specific number of luminaries, sequentially along a street or near a given street address, to pulse illumination or strobe. This could then signal a path to the driver of a vehicle as the vehicle travels on an illuminated street with a networked streetlight system in place. The luminaires could also be set to illuminate a certain color or change light intensity to signal or provide additional lighting for a vehicle.

The networked lighting system not only allows for communication between the central control system, the communication modules and the luminaires but the system would also allow an additional capability for communications module to be attached to traffic lights or signals, including the stop lights. This would allow a signal to be sent to the central control system from a communications module attached to a traffic light indicating that the traffic light was not functioning properly. The center control system could then send a signal to multiple luminaires in the area of the non-functioning traffic light. This could provide a visible signal to warn the oncoming traffic of the traffic light's condition.

Another implementation disclosed is a method of signaling and controlling a network of streetlights by initiating a signal from a central control system that changes a light setting a the luminaire of a streetlight. A communication module receiving the signal then initiates a second signal to communicate to the luminaire of a streetlight to change its light setting. Upon receiving the signal from the communications module, the luminaire changes its setting to either a pulse setting, change of color setting or a change in light intensity setting. The signal from the center control system may also be coupled with the presence of an emergency vehicle with a signal transmitting device proximate to the area where the luminaire of a streetlight is signaled. This implementation would result in a change in the luminaire setting if the luminaires received a signal both from the central control system and from a signal transmitting device of an emergency vehicle present in the area.

An additional networked streetlight system includes a signal between a central control system, communication modules and luminaires as well as with an emergency vehicle or other type of vehicle with a signal transmitting device. When the vehicle with the signal transmitting device is proximate to a communications module of a luminaire, the communications module recognizes the vehicle and transmits a signal back to the central control system to identify the location of the vehicle. This allows the central control system to track the location of the vehicle as it is in route to a specific destination. The system would also be capable of recognizing whether the vehicle is a specific vehicle or is of a specific class of vehicles such as police cars or a fire trucks. This network system may also include additional relays that facilitate the communication capabilities of communication modules. A relay may manage signals from multiple communication modules receiving as well as sending those signals to multiple luminaires. A relay may also receive signals from luminaires and send those signals to a central control system. The relay may be placed in strategic locations to track emergency vehicles that may have signal transmitting devices within a proximate area of the relay or within a proximate area of a specific street location.

An additional networked streetlight system may further comprise a vehicle recognition system coupled with at least one of the plurality of luminaires, the vehicle recognition system configured to recognize a signal emitted from at least one vehicle proximate to the at least one of the plurality of luminaires and indicate to the communication module corresponding to the at least one of the plurality of luminaires that the at least one vehicle is proximate. Networked streetlight systems may be configured such that the at least one of the plurality of communication modules of the corresponding at least one of the plurality of luminaires is configured to transmit a signal to the central control system in response to the indication from the corresponding at least one of the plurality of luminaires, to indicate to the central control system that the recognized at least one vehicle is proximate to the at least one of the plurality of luminaires. Systems may be configured such that the at least one vehicle is recognized by the central control system from the indication received by the central control system as being different from all other vehicles. The at least one vehicle may be recognized by the central control system from the indication received by the corresponding communication module from the at least one vehicle is recognized by the central control system as a vehicle belonging to a specific class of vehicles.

A method of signaling and controlling a network of streetlights may comprise initiating a first control signal from at least one central control system, the first control signal indicating an illumination setting change for at least one luminaire of a plurality of luminaires in the network of streetlights, receiving the signal at at least one of a plurality of communications modules each corresponding to at least one of the plurality of luminaires, and responsively initiating a second signal from the at least one of the plurality of communications modules to the at least one luminaire of the plurality of luminaires indicating the illumination setting change for the at least one luminaire, and receiving the second signal at the at least one luminaire and changing an illumination setting for the at least one luminaire in response to receiving the second signal, the illumination setting change comprising at least one of a change in an illumination pulse setting, a change in a light color setting and a change in a light intensity setting.

Particular implementations of the method may comprise one or more of the following features. The method may further comprise recognizing when an emergency vehicle is in proximity to at least a second luminaire, wherein initiating the first control signal for the at least one luminaire is in response to recognizing the proximity of an emergency vehicle to the at least the second luminaire. Initiating the first control signal for the at least one luminaire in the plurality of luminaires in the network of streetlights may comprise initiating the first control signal configured to sequentially alter the illumination setting change in at least two luminaires of the at least one luminaire to indicate to the emergency vehicle a direction in which to drive by following a visual indication of the illumination setting change through the at least two luminaires. Initiating the first control signal for the at least one luminaire in the plurality of luminaires in the network of streetlights may comprise initiating the first control signal configured to sequentially alter the illumination setting change in at least two luminaires of the at least one luminaire to indicate a direction by the sequence of the illumination setting change.

A method of signaling and controlling a network of traffic lights in relation to emergency vehicles may comprise providing a network of street lights each comprising a communication module in communication with at least one central control system, the central control system configured to transmit at least a first control signal to a communication module of the network of streetlights, the at least the first control signal indicating an illumination setting change for at least one luminaire in the network of streetlights, and at least a second control signal to the communication module of the network of streetlights, the at least the second control signal indicating a traffic preemption sequence for a traffic light near the at least one luminaire in the network of streetlights. In particular implementations, the method may further comprise receiving the indication of the traffic preemption sequence for the traffic light through the street light communication module, and initiating the preemption sequence in the traffic light in response to receiving the indication of the traffic preemption sequence. In particular implementations, the method may still further comprise identifying when at least one emergency vehicle is in proximity to at least a second luminaire in the network of streetlights and initiating the at least the second signal from the central control signal indicating the traffic preemption sequence in response to identifying when the at least one emergency vehicle is in proximity to the at least the second luminaire.

DESCRIPTION

Figure 1:
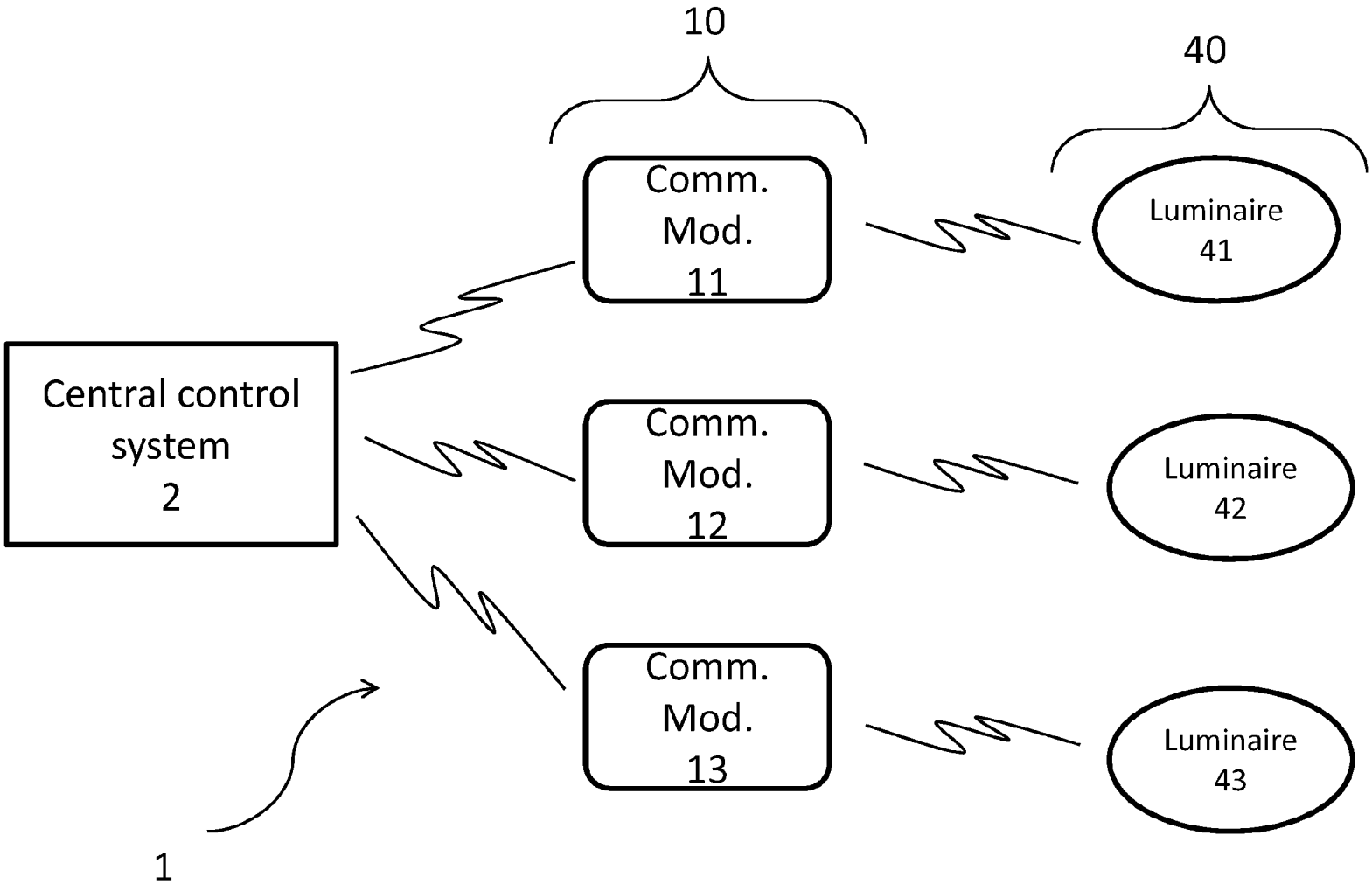
FIG. 1 is a block diagram of the networked streetlight system.

In the following description, and for the purposes of explanation, numerous specific details are set forth in order to provide a thorough understanding of the various aspects of the inventions disclosed herein. It will be understood, however, by those skilled in the relevant arts, that the principles learned from this disclosure may be practiced by those of ordinary skill in the art without these specific details. In other instances, known structures and devices are shown or discussed more generally in order to avoid obscuring more pertinent features. In many cases, a description of the operation is sufficient to enable one to implement the various forms of the devices and methods. It should be noted that there are many different and alternative configurations, devices and technologies to which the disclosure may be applied. The full scope of the inventions is not limited to the examples that are described below Particular implementations of networked streetlight systems include various elements. Particular implementations are illustrated as non-limiting examples in FIGS. 1-4. Referring specifically to FIG. 1, an implementation of a networked streetlight system 1 is illustrated. The networked system 1 of FIG. 1 includes a central control system 2 that communicates with one or with multiple communications modules 10. As an example, a communication may only occur between the central control system 2 and only one of the multiple communications modules 10, such as only with one of communications modules 11, 12 or 13. The central control system 2 may also send different communications to each of the control modules 11, 12 and 13. Equally, the networked control system 2 may include any number of communications modules 10 and it is contemplated that in most implementations there would be many, many more modules 10 and the three communications modules 11, 12, and 13 are shown here for illustrative purposes only.

The communication modules 10 receive communications from the central control system 2 and communicate with one or more luminaires 40. These luminaires 40 are specific to streetlights and are part of the standard housing required in streetlights or may also be part of custom designed streetlight housing. The streetlights with luminaires 40 are also positioned remotely along a street or road with the purpose of illuminating that area of the street or road. In addition to the luminaires 40 of this example having settings to enable them to be turned on and off, the luminaires 40 include up to three additional illumination settings: a pulse setting, a change in light color setting and a change in light intensity setting. The pulse illumination setting may be configured similar to a strobe light causing, as an example, a light emitting diode (LED) of a luminaire 41 to turn on and off rapidly in relatively quick succession. The change in light color illumination setting may cause the light to be changed to one of any colors specifically installed into a specific luminaire 41. As an example, LEDs may come in different colors and luminaires 40 may be changed to any color of LED installed, or an LED may be configured to change colors based on the voltage or current applied at its inputs. The change in light intensity illumination setting of luminaires 40 may allows an "on" luminaire's light intensity or brightness to be adjusted up or down depending upon the particular need at the time for a given situation. For example, the luminaires 40 may be controlled such that a select group of luminaires 40 at the scene of a crime or accident they illuminate brighter than is typical for that time of day, such as at the site of an accident or a police routine traffic stop. Although an LED is provided as an example because of specific advantages achieved when using LEDs, any one or more of the following lighting types may be used, an incandescent light, a fluorescent light, a high pressure sodium light, a metal halide light and a light emitting plasma light, or any other lighting type known in the art.

Pending U.S. patent application Ser. No. 12/417,558 entitled "Wireless Head for a Traffic Preemption System," to Sikora, et al., filed Apr. 2, 2009, the disclosure of which is hereby incorporated entirely herein by reference, provides examples of networked traffic signals and equipment for enabling communication modules that may be utilized in particular implementations of communications modules disclosed herein. U.S. Pat. No. 6,331,063 to Kamada et al., entitled "LED Luminaire with Light Control Means," issued Dec. 18, 2001, the disclosure of which is hereby entirely incorporated herein by reference, provides an example of an LED luminaire system that could be utilized in particular implementations disclosed herein.

A wide variety of LED devices may be utilized to form an LED luminaire 41, 42, 43 including, by non-limiting example, single chip LEDs, multiple color LEDs, multi-chip LEDs, and any other LED type or system. In various implementations, the LED luminaire 41 and/or the communications module 11 may be powered via a wired connection, a battery power source, or a combination of the two. The energy source for the battery powered implementations may be a solar panel or any other device for capturing energy at the location of the LED street light such as, by non-limiting example, a windmill, support vibration energy conversion device, and so forth.

Another implementation of the networked streetlight system 1 operates when the central control system 2 sends a different signal to each one of the multiple communications modules 11, 12 or 13 and that communications module signals each of the luminaires 41, 42 or 43 respectively. As an example, the central control system 2 may send a signal to communication module 11 which would then signal luminaire 41 to change its illumination setting to pulse lighting. Similarly, a signal from central control system 2 to communications modules 12 and 13 may signal luminaires 42 and 43 to change color and light intensity respectively. The control system could also send the same signal to all the communication modules 10 to signal all the luminaires 40 to change to one particular setting.

Figure 2:
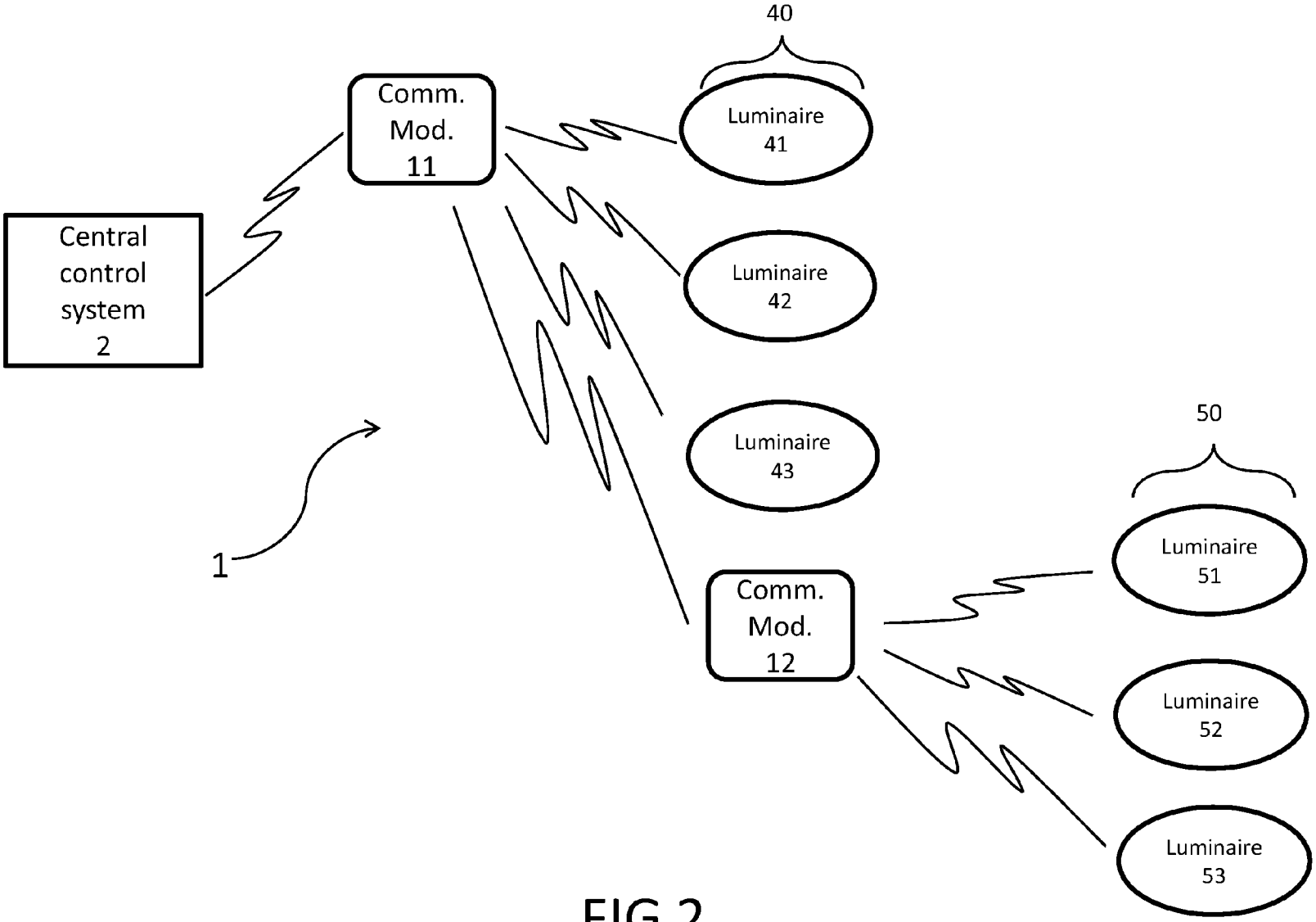
FIG. 2 is a block diagram of the networked streetlight system including communications module relays.

Another implementation is represented in FIG. 2 and illustrates that a signal can be communicated from the central control system 2 to a communications module 11 and then that signal is further communicated to multiple luminaires, 41, 42, and 43 in this example. The communications output setting on communications module 11 is sufficient to change the light setting on all the luminaires 41, 42, and 43 within a certain distance while also communicating to a second communications module 12. Communications module 12 would then send a signal to other luminaires 51, 52 and 53 within another distance. This process may be duplicated for any number of communication modules.

Thus, a communications module 11 may operate as a relay or component in a mesh network that includes all of the luminaires 41, 42 and 43 of specific streetlights in a particular area. The second node would be communications module 12 signaling luminaires 51, 52 and 53 of streetlights in another area. This would minimize the power required for the central controls system 2 or of a given communications module 11 or 12 through implementing algorithms that ensure that the output power of the communications module 11 is sufficient to reach the next node or communication module 12 in this example of a network, but not significantly greater. Even in implementations where a single communication module 11, 12 communicates with multiple luminaires 41, 42, 43, 51, 52, 53, the signal from the central control system 2 indicating to the one or more luminaires 41, 42, 43, 51, 52, 53 to change illumination settings or to define particular parameters for the illumination parameters, it is contemplated that the single communication module 11, 12 may indicate to the luminaires 41, 42, 43, 51, 52, 53, separate instructions or at least separate timing for the instructions and does not need to communicate exactly the same instruction to all of the luminaires 41, 42, 43, 51, 52, 53. Where multiple luminaires 40, 50 are arranged in a mesh network, the overall power output and power consumption of all of the communications modules 10 in the network may be reduced. This is because the mesh network allows the central control system 2 to communicate with a group of luminaires 40, 50 of streetlights through communication to only one communications module 11, which subsequently communicates to luminaires 40 and to communications module 12.

The implementations contemplate wireless communication from the central control system 2 to the communications modules 10 in FIG. 1 as well as from the central control system 2 to the communications module 11 in a network in FIG. 2. The central control system 2 and the communication modules 10 (FIG. 1) may utilize any of a wide variety of conventional wireless and radio communication systems, including, by non-limiting example, Wireless Fidelity (WiFi®), Bluetooth®, 802.11a, 802.11b, 802.11g, 802.11n, 802.16 (WiMAX), amplitude modulated, frequency modulated, microwave, satellite, cellular telephone, or any other wireless telecommunication network type.

Power line communications may also be employed to allow signals to be sent from the central control system 2 to the communications modules 10 and to luminaires 40 as shown in FIG. 1 and to the communications module 11 and 12 and luminaires 40 and 50 as shown in FIG. 2. U.S. Patent Application Publication No. 20080304577, to Koga et al., entitled "Power-Line Communication Method, Power-Line Communication Device, and Power-Line Communication System," published Dec. 11, 2008, the disclosure of which is hereby incorporated entirely herein by reference, is an example of a power line communication system and related devices which, after one of ordinary skill in the art reviews this disclosure, will be understood to be used in particular implementations of the streetlight systems disclosed herein.

The communications module 11 may also incorporate the components of any of a wide variety of power line communication systems, including high, medium, or low frequency systems or broadband over power line systems. In these implementations, the wires powering the luminaire 41 may be utilized to transmit signals and bidirectionally or unidirectionally connect each streetlight in the streetlight system with a central control system 2 that can then send signals to the units or retrieve information from them. When existing wiring is being used, the power consumption of the communications module 11 may be reduced, because the signal does not have to be amplified or otherwise processed to be broadcast over an antenna. In implementations of streetlights utilizing power line communication techniques, the communications module 11 may not require the use of an antenna and may include any of a wide variety of power line communication modem devices.

Where the plurality of communications modules are connected to a central control system 2 via wireless connections or power line communication systems-based connections using any of the various methods disclosed in this document, the central control system 2 may be enabled to run adaptive algorithms that dim and/or time the lights to correspond with light levels for a given day, week, month, or time of year. In addition, the central control system may be enabled in particular implementations to turn on some or all of the luminaires 40 in a particular area or according to a particular pattern (all on, alternating, etc.) when light levels drop below certain predetermined thresholds under various daytime or weather conditions to operate as an additional safety warning to motorists not previously possible in conventional streetlighting systems.

Figure 3A:
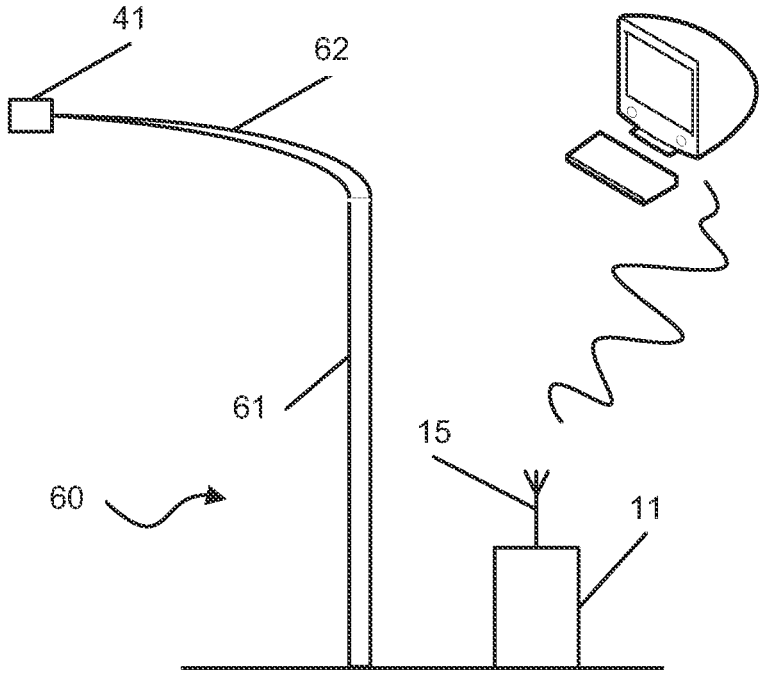
FIGS. 3A-3C depict representations of the luminaire housing and communications modules coupled from different locations to the luminaire housing.
Figure 3B:
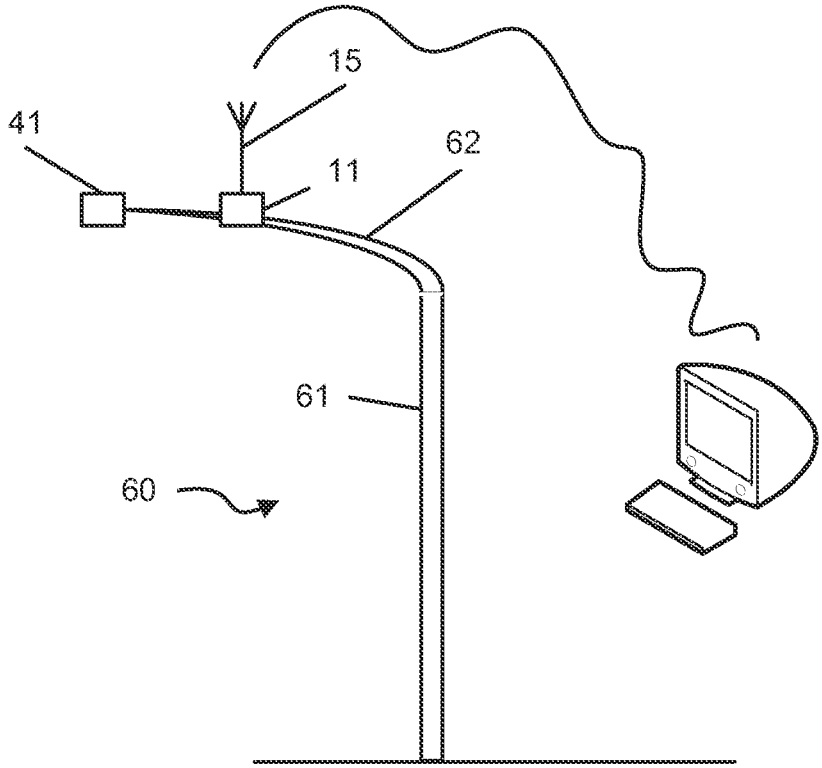
Figure 3C:
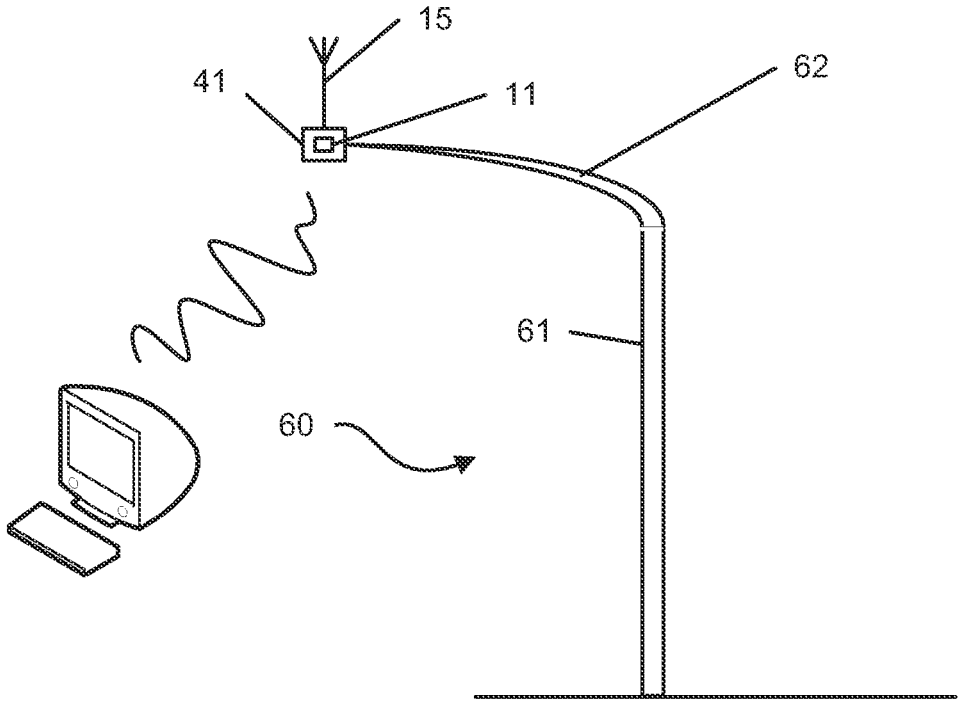

FIGS. 3A-3C provide non-limiting examples of a streetlight 60 with a communications module 11 placed in different locations with respect to the luminaire 41 on each of the examples. FIG. 3A shows a streetlight 60 with a luminaire 41 above a street. The communications module 11 for this particular embodiment is supported by a separate structure from the streetlight 60 and the luminaire 41. This support could include area housing on the ground near the streetlight 60 or on a traffic signal arm support such as a traditional red, yellow and green traffic light or pedestrian crossing traffic signal support sign. Antenna 15 represents that the signal sent between the communications module 11 and the luminaire 41 may be wireless but as previously referenced, the signal may also be sent through power lines or other physical communication lines rather than wirelessly. It is specifically contemplated that the central control system 2 will be located at a far remote location from the communications module 11, even up to miles or tens of miles away, and may communicate with the communications modules 41 either wirelessly or via power lines.

FIG. 3B represents a streetlight 60, like the implementation of FIG. 3A, but with the communications module 11 mounted to the streetlight arm 62. The communications module could also be mounted to the streetlight support base 61 or anywhere on the streetlight 60 itself. FIG. 3C shows another implementation like the implementation of FIG. 3A, but where the communications module 11 is also a component of the luminaire 41. This configuration may facilitate the capability for the communications module 11 to readily identify a specific characteristic of the luminaire 41, such as its current setting, whether it is functioning properly, or the state of some sensor associated with the luminaire 41. The communications module 11 is configured to determine the status of the luminaire 41 and transmit a signal to the central control system 2 with this status. Thus, it should be understood that communications with the central control system from the communications modules or luminaires in any of the implementations disclosed herein may be one way, to send a signal to the luminaire, or two way, to send to and receive from the luminaire.

Although the communications module 11, as a component associated directly with the luminaire 41 may facilitate monitoring the status of the luminaire 41, the communications module 11 may be positioned anywhere on the streetlight 60 or in a remote location, away from the streetlight 60. Also, information about the condition of the components of the luminaire 41 any ambient characteristic may be reported via the connection, including, but non-limiting as example, operating hours, light intensity, power quality, ambient light conditions, humidity, traffic volume (if equipped with a traffic sensor), or any other desired characteristic. In particular limited implementations in addition to incorporating the communications module 11 with a streetlight, the communications module 11 may also be incorporated with any of a wide variety of conventional traffic control devices near intersections or a power box, a telecommunication structure, or any other structure capable of supporting and allowing signals to and from the communications module 11.

Figure 4:
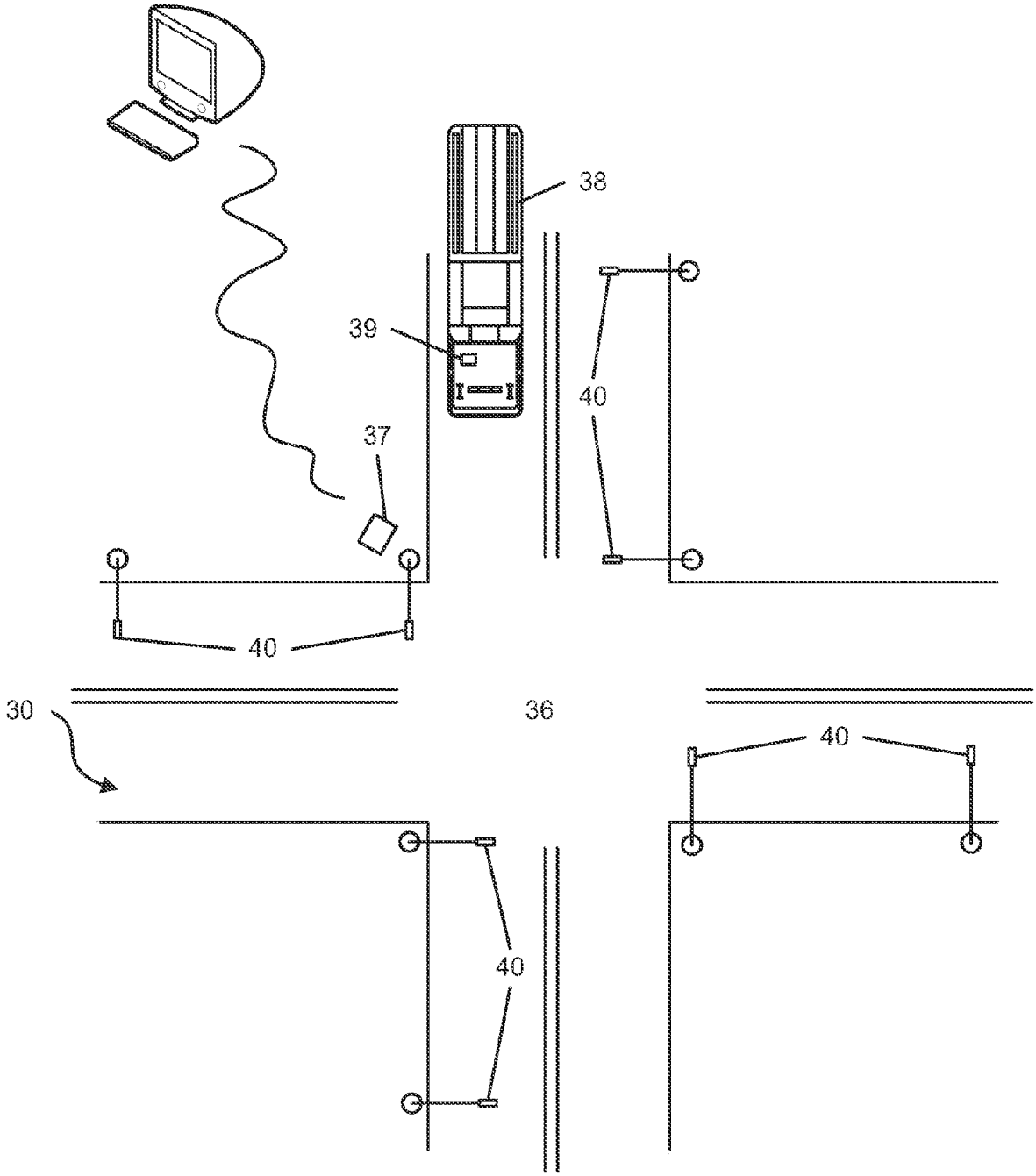
FIG. 4 depicts a representation of a road with a networked streetlight system.

Referring to FIG. 4, an example of a networked streetlight system 30 arranged adjacent to a road and an intersection 36 is illustrated. While an intersection 36 is illustrated, the principles disclosed could be applied to any grouping or arrangement of streetlights in a networked streetlight system 30 such as on a freeway, in a rural area or on city streets or highways. The example is illustrated at an intersection 36 for clarity purposes for one of the particular implementations described. As illustrated, the networked streetlight system 30 includes a plurality of streetlights with luminaires 40, which could be structured like any of the implementations disclosed in this document. In this implementation, each of the luminaires 40 includes a communications module 11 as represented in FIG. 3C and may be capable of communicating with a central control system via a wireless connection or a power line communication system.

FIG. 4 also includes a relay module 37 that is a separate communication device from the communication modules within the housing of the luminaires 40 in this implementation. Alternatively, any of the communication modules may be configured as a relay module as discussed previously. For this particular implementation, communication occurs when the communications module within the luminaire 40 of each streetlight to connects with a relay module 37 at the intersection 36. Relay module 37 subsequently transmits signals to and receives signals from each of the luminaires 40 within a specified area. In other implementations, each of the streetlight luminaires 40 may connect directly to the central control system using its communications module. In FIG. 4, the luminaires 40 are clearly represented as part of overhead streetlight housing intended to illuminate the surface of the street. Other implementations may include luminaires housed within side supports along a street or along barriers of a freeway and used only as visible signals to passing vehicles and not necessarily to illuminate a street. The implementation in FIG. 4 is only intended as a non limiting example of a networked streetlight system.

In other particular implementations, the central control system 2 could receive information that an emergency vehicle 38 is traveling to a particular destination by a transmission from a communication module on a traffic signal at an intersection, or by other methods. For example, the emergency vehicle 38 may include a signal transmitting device 39 within or on the emergency vehicle 38. The central control system could also receive additional information as to the current location of the emergency vehicle 38 from any of a wide variety of signal transmitting devices 39. By non-limiting example, the transmitting devices may include a global positioning system (GPS) receiver or any other method or system of tracking the position of a moving vehicle.

It is presumed that at a central control system location, such as at a 911 dispatch center, the central control system will be aware of the anticipated destination for the emergency vehicle 38. With the information about the destination of the emergency vehicle 38 and with knowledge of its current location, the central control system 2 may be configured so that it can cause the luminaires 40 to signal the operator of the emergency vehicle 38 the direction he or she should take toward a target destination. The signal may be created by changing the illumination of a sequential number of luminaires 40 by blinking, flashing, strobing, forming an alternating and/or moving pattern of consecutive illuminated streetlights, changing light color settings, or any other method of visually attracting the attention of the attending operator. In other particular implementations, the central control system may be configured to receive information regarding the emergency vehicle 38 through the communications module and thereby track the relative positioning of the emergency vehicle 38 more precisely than only at the intersections.

In other particular implementations, the networked system of streetlights, by non-limiting example like the one shown and described with reference to FIG. 4, may further comprise one or more traffic lights included in the network and being associated with wired or wireless communication modules. In such implementations, the central control system may communicate with the traffic lights through the streetlight network such as, for example, by relaying a communication to a particular traffic light at a particular intersection through one or more streetlight network communication modules to initiate a traffic preemption sequence for the light. As with previous implementations described in relation to changing illumination settings for street lights, implementations involving a traffic light may include tracking or identifying the location of an emergency vehicle and automatically initiating the traffic preemption sequence for a traffic light along an intended travel path of the emergency vehicle to arrive at its destination. By knowing the ultimate destination of the emergency vehicle and having access to the traffic lights through a street light network of communication modules, a central control system may more smoothly and safely manipulate traffic signals to allow emergency vehicles to arrive at emergency locations more safely and with less disruption to traffic. In particular implementations, as a further notice to vehicles at an intersection being manipulated, streetlights in the area of the intersection may also be made to change illumination settings, for example to strobe or to change colors, to notify drivers that an emergency vehicle is coming.

Figure 5:
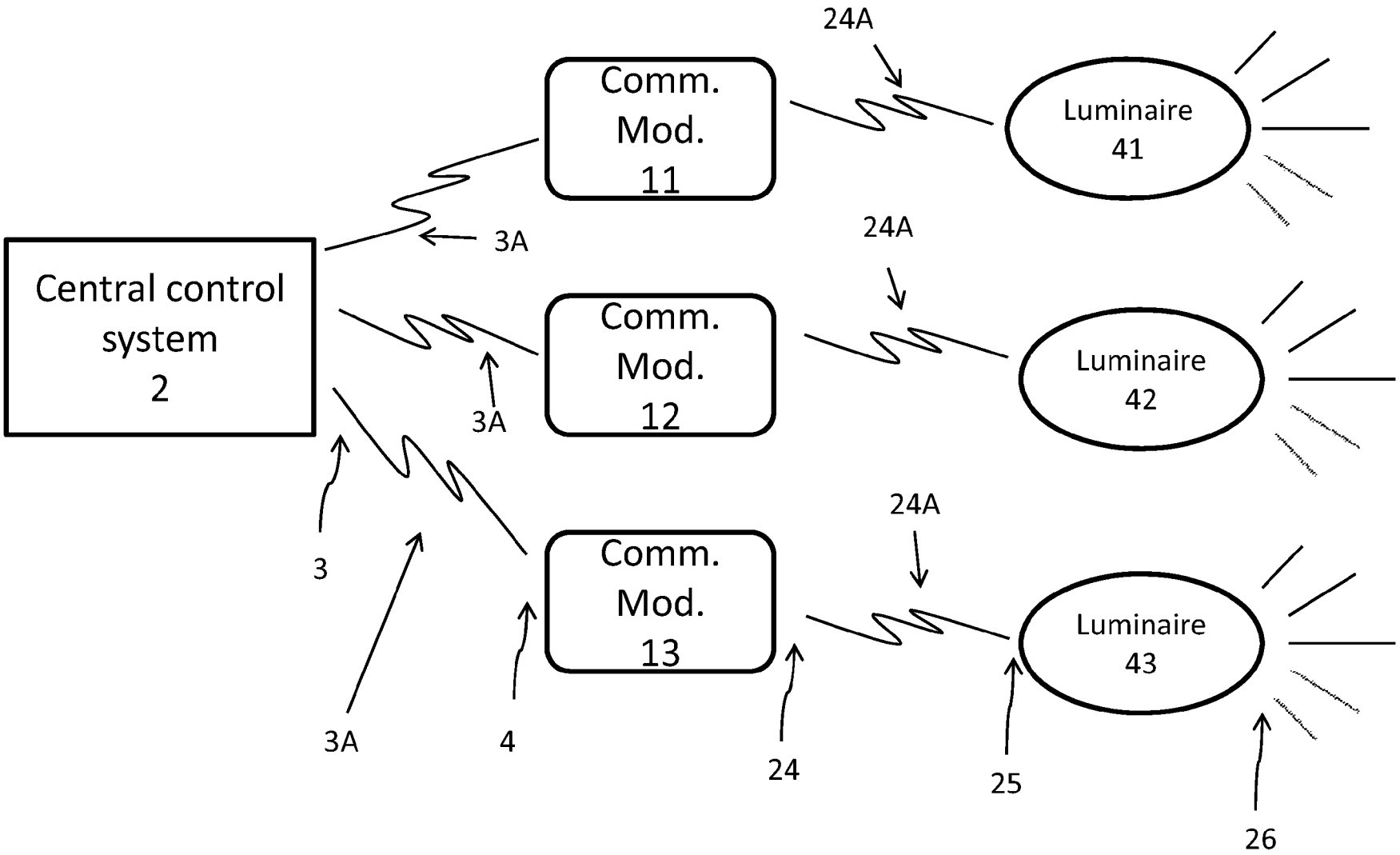
FIG. 5 depicts a method of a networked streetlight system.

FIG. 5 is a block diagram of a method of signaling and controlling a network of streetlights that includes a central control system 2 initiating signals 3A (step 3) that indicate a setting change for one or more luminaires 41, 42 or 43. Although FIG. 5 depicts three luminaires 41, 42 and 43, two signals 3A and 24A, and three communication modules 11,12 and 13, other implementations may include only one or multiple signals, communication modules and luminaires. Communications modules 11, 12 and 13 receiving signals 3A (step 4) responsively initiate signals 24A (step 24). Luminaires 41, 42 and 43 receiving signals 24A (step 25) responsively change the light settings (step 26). This method may also include other wired or wireless devices that are able to initiate, relay, amplify, reduce, or dampen a signal as may be needed for a given networked streetlight system.

The materials used for implementations of networked streetlight systems like those disclosed in this document may be made of conventional materials used to make goods similar to these in the art, such as, by non-limiting example, plastics, metals, semiconductor materials, composites, rubbers, and the like. Those of ordinary skill in the art will readily be able to select appropriate materials and manufacture these products from the disclosures provided herein.

The implementations listed here, and many others, will become readily apparent from this disclosure. From this, those of ordinary skill in the art will readily understand the versatility with which this disclosure may be applied. The foregoing and other aspects, features, and advantages will be apparent to those artisans of ordinary skill in the art from the DESCRIPTION and DRAWINGS, and from the CLAIMS.

The invention claimed is:

1. A networked streetlight system comprising:

a plurality of luminaires each within a separate, remotely positioned streetlight housing;

a plurality of communications modules each positioned near a corresponding one of the plurality of luminaires, wherein each of the plurality of communications modules is configured to communicate with its corresponding one of the plurality of luminaires;

a central control system configured to communicate with each of the plurality of communications modules wherein the control system signals at least one of a plurality of communication modules coupled to a traffic light to effect at least one change in an illumination setting of the traffic light; and a vehicle recognition system coupled with at least one of the plurality of luminaires, the vehicle recognition system configured to recognize a signal emitted from at least one vehicle proximate to the at least one of the plurality of luminaires and indicate to the communication module corresponding to the at least one of the plurality of luminaires that the at least one vehicle is proximate, the communication module further configured to communicate a presence of the recognized signal to the traffic light to effect the at least one change in the illumination setting of the traffic light.

2. The networked streetlight system of claim 1, wherein the change in a light color setting comprises a change to at least one of a plurality of colors.

3. The networked streetlight system of claim 1, wherein the communications module is coupled to the corresponding luminaire within the streetlight housing of the corresponding luminaire.

4. The networked streetlight system of claim 1, wherein the luminaire comprises at least one LED.

5. The networked street lighting system of claim 1, wherein the luminaire comprises one of an incandescent light, a fluorescent light, a high pressure sodium light, a metal halide light and a light emitting plasma light.

6. The networked streetlight system of claim 1, wherein when the at least one of the plurality of communication modules signals to its corresponding one of the plurality of luminaires, it signals through a power line connection.

7. The networked street lighting system of claim 1, wherein the communication module comprises an antenna and is configured to signal the luminaire through a wireless connection.

8. The networked streetlight system of claim 1, wherein the plurality of communication modules further comprises a first plurality and a second plurality of communications modules, wherein each of the first plurality of communications modules is configured to relay a central control system signal from the central control system to at least one communication module from the second plurality of communication modules.

9. The networked streetlight system of claim 1, wherein the communication module is mounted on a traffic signal support.

10. The networked streetlight system of claim 1, wherein the control system is configured to signal a specific number of the plurality of luminaires to strobe along a street in a direction toward a selected location.

11. The networked streetlight system of claim 1, wherein at least one of the plurality of communications modules is further configured to send signals to the central control system.

12. The networked streetlight system of claim 1, wherein the central control system is further configured to communicate with a plurality of traffic lights comprising a plurality of traffic light communication modules each configured to send and receive signals to and from the central control system.

13. The networked streetlight system of claim 12, wherein the central control system is configured to receive a communication from the at least one of the plurality of traffic light communication modules and further configured to communicate with at least one of the plurality of communication modules to signal to at least one of the plurality of luminaires to alter at least one of three settings in response to the communication from the at least one of the plurality of traffic light communication modules.

14. The networked streetlight system of claim 12, wherein the central control system is configured to communicate with the plurality of traffic lights by sending a traffic preemption signal through the streetlight communication module to the traffic light communication module.

15. The networked streetlight system of claim 14, wherein the communication from the at least one of the plurality of traffic light communication modules is that the at least one of the plurality of traffic lights is not functioning properly.

16. The networked streetlight system of claim 15, wherein the at least one of the at least three settings on at least a selected quantity of the plurality of luminaires proximate to the at least one non functioning traffic light is changed to at least one of a plurality of colors.

17. The networked streetlight system of claim 15, wherein the change to at least one of a plurality of colors on the selected quantity of the plurality of luminaires is a visible signal that a traffic light is not functioning properly.

18. The networked streetlight system of claim 1, wherein the at least one of the plurality of communication modules of the corresponding at least one of the plurality of luminaires is configured to transmit a signal to the central control system in response to the indication from the corresponding at least one of the plurality of luminaires, to indicate to the central control system that the recognized at least one vehicle is proximate to the at least one of the plurality of luminaires.

19. The networked streetlight system of claim 1, wherein the at least one vehicle is recognized by the central control system from the indication received by the central control system as being different from all other vehicles.

20. The networked streetlight system of claim 1, wherein the at least one vehicle is recognized by the central control system from the indication received by the corresponding communication module from the at least one vehicle is recognized by the central control system as a vehicle belonging to a specific class of vehicles.

21. A method of signaling and controlling a network of streetlights in relation to emergency vehicles, the method comprising:

initiating a first control signal from at least one central control system in response to receipt by the at least one central control system of an indication from a vehicle recognition system coupled with at least one luminaire of a plurality of luminaires, of a proximate position of at least one emergency vehicle, the first control signal indicating an illumination setting change for a first traffic light that is in networked communication with the plurality of luminaires;

receiving the signal at at least one of a plurality of communications modules each corresponding to at least one of a plurality of traffic lights, and responsively initiating a second signal from the at least one of the plurality of communications modules to at least a second traffic light of the plurality of traffic lights indicating the illumination setting change for the second traffic light;

receiving the second signal at the second traffic light and changing an illumination setting for the second traffic light in response to receiving the second signal, the illumination setting change comprising at least one of a change in an illumination pulse timing setting, and a change in a light color setting.

22. The method of claim 21, further comprising recognizing when the at least one emergency vehicle is in proximity to at least a second luminaire, wherein initiating the first control signal for the at least one luminaire is in response to recognizing the proximity of an emergency vehicle to the at least the second luminaire.

23. The method of claim 22, wherein initiating the first control signal for the at least one luminaire in the plurality of luminaires in the network of streetlights comprises initiating the first control signal configured to sequentially alter the illumination setting change in at least two luminaires of the at least one luminaire to indicate to the emergency vehicle a direction in which to drive by following a visual indication of the illumination setting change through the at least two luminaires.

24. The method of claim 21, wherein initiating the first control signal for the at least one luminaire in the plurality of luminaires in the network of streetlights comprises initiating the first control signal configured to sequentially alter the illumination setting change in at least two luminaires of the at least one luminaire to indicate a direction by the sequence of the illumination setting change.

25. A method of signaling and controlling a network of traffic lights in relation to emergency vehicles, the method comprising:

providing a network of street lights each comprising a communication module in communication with at least one central control system, the central control system configured to transmit:

at least a first control signal to a communication module of the network of streetlights, the at least the first control signal indicating an illumination setting change for at least one luminaire in the network of streetlights; and at least a second control signal to the communication module of the network of streetlights, the at least the second control signal indicating a traffic preemption sequence for a traffic light near the at least one luminaire in the network of streetlights;

wherein the central control system is further configured to receive an indication from a vehicle recognition system that is coupled to the at least one luminaire that at least one vehicle is proximate to the at least one luminaire in response to a recognition by the vehicle recognition system of a signal emitted by the at least one vehicle;

receiving the indication of the traffic preemption sequence for the traffic light through the street light communication module; and initiating the preemption sequence in the traffic light in response to receiving the indication of the traffic preemption sequence.

26. The method of claim 25, further comprising identifying when at least one emergency vehicle is in proximity to at least a second luminaire in the network of streetlights and initiating the at least the second signal from the central control signal indicating the traffic preemption sequence in response to identifying when the at least one emergency vehicle is in proximity to the at least the second luminaire.

* * * * *